US005580495A

United States Patent [19]

Young

[11] Patent Number: 5,580,495

[45] Date of Patent: Dec. 3, 1996

[54] LIQUID SHAMPOO FOR CARPETS

[76] Inventor: Robert Young, 8601 Roland St., Suite A, Buena Park, Calif. 90621

[21] Appl. No.: 405,942

[22] Filed: Mar. 17, 1995

[51] Int. Cl.[6] ..... C11D 3/34; C11D 3/065; C11D 3/08

[52] U.S. Cl. ..... 510/340; 510/341; 510/427

[58] Field of Search ..... 252/549, 550

[56] References Cited

U.S. PATENT DOCUMENTS

| | | | |
|---|---|---|---|
| 3,779,705 | 12/1973 | Kitamura et al. | 8/173 |
| 4,395,347 | 7/1983 | McLaughlin et al. | 252/139 |
| 4,490,270 | 12/1984 | Hackett et al. | 252/106 |
| 4,552,692 | 11/1985 | Gillespie | 252/528 |
| 4,714,559 | 12/1987 | Steltenkamp et al. | 252/8.8 |
| 4,721,633 | 1/1988 | Baldassin | 427/212 |
| 4,906,396 | 3/1990 | Falholt et al. | 252/174.12 |
| 5,314,636 | 5/1994 | Rek et al. | 252/139 |

*Primary Examiner*—Paul Lieberman
*Assistant Examiner*—Wyatt B. Pratt
*Attorney, Agent, or Firm*—Stuart W. Knight

[57] ABSTRACT

A carpeting shampoo is provided wherein several sodium salts, namely, sodium pyrophosphate, sodium silicate and sodium sulfate are added to a sodium lauryl sulfate detergent to form an aqueous solution. Also added is a alcohol, an amine and a glycol ether. The addition of such alkali metal salts enhances the cleaning effectiveness of such detergent.

4 Claims, No Drawings

LIQUID SHAMPOO FOR CARPETS

BACKGROUND OF THE INVENTION:

This Invention relates to carpet cleaning compositions or shampoos.

The art is abundant with various compositions utilized to shampoo carpets, rugs, and other like fabrics.

In recent times, a variety of liquid detergent compositions have been developed for the purpose of cleaning carpets. Generally, an aqueous shampoo composition is utilized comprising a surfactant detergent; various solvents; color, odor and other additives; and water. The carpet industry has developed tougher and longer lasting synthetic fibers and hence, carpets, in general, are longer lasting. This has placed an increased pressure for the development of suitable carpet cleaning compositions. After application of the aqueous solution, there is developed a shampoo residue which is removed from the carpet fibers by vacuum cleaning. Thus, development of suitable cleaning composition must consider the efficiency of removing the residue after the cleaning operation.

Competition in the carpet cleaning business has resulted in economic incentives for development of less expensive cleaning compositions that will effectively remove soil and stains from carpets. Thus, one principal concern in the development of a suitable shampoo is the cost of the ingredients added to water.

The prior art is replete with shampoo compositions. For example, in U.S. Pat. No. 4,983,317 by Requejo, et al., a cleaning composition was developed comprising a polyacrylic acid and a cyclo hexane dicarboxylic acid, along with other various materials, including a polylacrylic resin. In U.S. Pat. No. 2,787,596 by Stewart, et al., there was developed a composition comprising a sodium alkyl sulfate along with kerosene and ammonium sulfate. In U.S. Pat. No. 3,835,071 by Allen, et al. , a water soluable metal salt of a styrene-maleic anhydride copolymer is utilized as the detergent or active material. In U.S. Pat. No. 4,490,270 by Hacket, et al., the surfactant sodium lauryl sulfate is utilized together with a glutaraldehyde, as an active sanitizer. In U.S. Pat. No. 3,122,508 by Grifo, et al. the poly phosphate and certain esters are utilized. In U.S. Pat. No. 3,039,971 by Cohen, a detergent paste is comprised of a pyrophosphate, a sodium silicate, a cellulose, lauryl alcohol sulfate and water. It should be noted in the Cohen patent, water only comprises fifty percent of the solution. Accordingly, it is apparent that the bulk of the solution is the organic additives, such as the pyrophosphate and lauryl alcohol sulfate, such that in all probability, the detergent is of high cost. In U.S. Pat. No. 3,919,101 by Anstett an aerosol composition is composed of a higher aliphatic alcohol, silica water and propellant with the water soluable surfactant. Finally, in U.S. Pat. No. 2,920,045 by Hearn, et al., the composition comprises a detergent, alcohol solvent, water, a polyphosphate, castor oil wax, and urea is presented. It is evident from some of the above that the cost may be prohibitive. For example, in U.S. Pat. No. 2,920,045, looking at example II on column 6, the water content is only ten percent, indicating that the remaining 50% is comprised of various organic materials which are obviously expensive. In short, even though the cleaning efficiency may be high, the shampoo may be cost-prohibitive.

Accordingly, one object of the Invention is to provide a shampoo which effectively removes dirt, stains, and the like, from fabrics. Another object of the Invention is to provide an effectie shampoo which has a low amount of organic and inorganic materials added to water. Further objects of the Invention will be apparent from the following discussion.

DISCLOSURE OF THE INVENTION:

The Invention herein comprises the addition of a unique combination of inorganic salts to a known alkyl sulfate detergent In a preferred embodiment, the solution added to water includes a fatty amine surfactant and an ethylene glycol ether. The above inorganic salts and alkyl sulfate detergence comprises less than 15% by weight of the shampoo.

The novel salts comprise an alkali pyrophosphate, an alkali silicate and an alkali sulfate. Preferrably, the alkali is sodium, however, potassium may be utilized. Accordingly, the preferred salts are sodium pyrophosphate, sodium silicate and sodium sulfate.

The above inorganic alkali metal salts comprise about two to ten weight percent of the aqueous solution, preferrably four to eight percent of the solution. Each of the alkali metal salts are generally added in equal porportions, i.e., one third being the pyrophosphate; one third being the silicate; and one third being the sulfate. However, one salt may be as low as ten percent in comparision with the other salts, i.e., ten percent can be the pyrophosphate; ten percent being the silicate and eighty percent being the sulfate. Likewise, the silicate may be ten percent, sulfate ten percent; and the remainder being pyrophosphate.

It has been found that the addition of the above alkali metal salts, in combination, results in a highly effective shampoo.

The preferred organic detergent is an aliphatic detergent of a higher alkyl sulfate, having six to sixteen carbons in the fatty alcohol. The most preferred and most generally utilized detergent is sodium lauryl sulfate. Sodium lauryl sulfate is a known and widely used detergent, as exemplified by the disclosures in the above-referenced patents. The concentration of such detergent is less than 10% by weight of the entire aqueous solution and generally 3%–10%, preferrably 4%–8% of the solution. Thus, the cost of the subject detergent is reasonable. It should be noted that in U.S. Pat. No. 2,920,045, the amount of such detergent is 25% of the solution and in U.S. Pat. No. 3,039,971, the amount of such detergent is 26.5%.

A aliphatic alcohol, having less than ten carbons, can be utilized as an addition to the water solvent and as an additive solvent. Examples include ethenol, propanol, isopropanol, butyl alcohol and the like. Such alcohol enhances the soluability of the above alkali metal salts in the detergent/water solution.

A fatty amine surfactant may be added. Preferrably, the fatty amine is a polyethoxylated fatty amine. Additionally, a diethylene glycol monobutyl ether or ethylene glycol monobutyl ether marketed under the trade name "Butyl Cellosolve" may be utilized to enhance the effectiveness. Any fragrance enhancer may be utilized such as a known material marketed under the trade name "Limonene". The fatty amine, isopropanol, Butyl Cellosolve and Limonene are utilized in practically trace amounts, less than 1% by weight of the solution.

Accordingly, the solution comprises of less than 10% of the known sodium lauryl sulfate detergent and less than 10% by weight of the above-identified alkali metal salts, the balance being primarily water as well as the trace amounts of the other above-identified ingredients.

EXAMPLE OF A TYPICAL COMPOSITION:

Below is an example of a preferred and typical composition:

| Component | Concentration (% by Weight) |
|---|---|
| Sodium lauryl sulfate | 7.5 |
| Alkali Salts: | 5.4 |
| Sodium pyrophosphate | |
| Sodium silicate | |
| Sodium sulfate | |
| Polyethoxylated fatty amine | 0.5 |
| Isopropanol | 0.6 |
| Butyl cellosolve | 0.4 |
| Limonene | 0.007 |
| Water | balance |

It has been found that the above composition results in a highly effective shampoo for carpets.

The solution is highly alkaline, having a pH of above 10, and preferrably 10 to 13. Accordingly, the solution is quite strong, resulting in highly effective cleaning shampoo.

I claim:

1. An aqueous liquid detergent composition used for the cleaning of fabrics, comprising three to ten percent by weight of sodium lauryl sulfate and two to ten weight percent of alkali sodium salts comprising sodium pyrophosphate; sodium silicate; and sodium sulfate, said weights being weight of the total composition.

2. The detergent composition of claim 1 wherein the total amount of the sodium salts is four to eight percent by weight of the total aqueous solution.

3. The composition of claim 1 to which is added a polyethoxylated fatty amine in an amount less than one percent by weight of the total solution.

4. The composition of claim 1 to which is added ethylene glycol monobutyl ether.

* * * * *